US006741828B2

(12) United States Patent
Marsh

(10) Patent No.: US 6,741,828 B2
(45) **Date of Patent: *May 25, 2004**

(54) METHOD FOR REDUCING RUB-OFF FROM A TONER IMAGE USING A PHASE CHANGE COMPOSITION

(75) Inventor: Dana G. Marsh, Newark, NY (US)

(73) Assignee: Heidelberg Digital L.L.C., Rochester, NY (US)

( * ) Notice: Subject to any disclaimer, the term of this patent is extended or adjusted under 35 U.S.C. 154(b) by 28 days.

This patent is subject to a terminal disclaimer.

(21) Appl. No.: 10/190,757

(22) Filed: Jul. 8, 2002

(65) Prior Publication Data

US 2003/0031485 A1 Feb. 13, 2003

Related U.S. Application Data

(60) Provisional application No. 60/310,873, filed on Aug. 8, 2001.

(51) Int. Cl.[7] ..... G03G 15/20
(52) U.S. Cl. ..... 399/342; 347/155
(58) Field of Search ..... 399/1, 341, 342, 399/324, 325; 430/97; 347/98, 212, 99, 155; 346/135.1; 427/146

(56) References Cited

U.S. PATENT DOCUMENTS

| | | | | |
|---|---|---|---|---|
| 3,653,932 A | | 4/1972 | Berry et al. | |
| 3,715,219 A | | 2/1973 | Kurz et al. | |
| 3,984,809 A | | 10/1976 | Dertouzos et al. | |
| 4,250,511 A | | 2/1981 | Stein et al. | |
| 4,390,369 A | | 6/1983 | Merritt et al. | |
| 4,447,818 A | | 5/1984 | Kurata et al. | |
| 4,458,253 A | | 7/1984 | Goff, Jr. et al. | |
| 4,484,948 A | | 11/1984 | Merritt et al. | |
| 4,490,731 A | | 12/1984 | Vaught | |
| 4,568,949 A | | 2/1986 | Muranaka | |
| 4,659,383 A | | 4/1987 | Lin et al. | |
| 4,666,757 A | | 5/1987 | Helinski | |
| 4,721,635 A | | 1/1988 | Helinski | |
| 4,738,555 A | * | 4/1988 | Nagashima | 400/240 |
| 4,745,420 A | | 5/1988 | Gerstenmaier | |
| 4,851,045 A | | 7/1989 | Taniguchi | |
| 4,889,560 A | | 12/1989 | Jaeger et al. | |
| 4,908,669 A | * | 3/1990 | Yamamoto | 399/335 |
| 5,006,170 A | | 4/1991 | Schwaz et al. | |
| 5,018,640 A | * | 5/1991 | Morofuji et al. | 347/112 |
| 5,092,235 A | | 3/1992 | Rise | |
| 5,151,120 A | | 9/1992 | You et al. | |
| 5,182,572 A | | 1/1993 | Merritt et al. | |
| 5,185,035 A | | 2/1993 | Brown et al. | |
| 5,220,343 A | * | 6/1993 | Takanashi et al. | 347/212 |
| 5,306,381 A | * | 4/1994 | Nakazawa et al. | 399/69 |
| 5,372,852 A | | 12/1994 | Titterington et al. | |
| 5,389,958 A | | 2/1995 | Bui et al. | |
| 5,495,270 A | | 2/1996 | Burr et al. | |
| 5,541,624 A | | 7/1996 | Cooke et al. | |
| 5,569,540 A | | 10/1996 | Hirose et al. | |
| 5,598,195 A | | 1/1997 | Okamoto et al. | |

(List continued on next page.)

FOREIGN PATENT DOCUMENTS

EP 1205809 A2 * 5/2002 ..... G03G/8/00

*Primary Examiner*—Robert Beatty

(57) ABSTRACT

A method for reducing rub-off from a substrate having a front side and a back side with the front side, back side, or both sides bearing toner images, by depositing a substantially clear phase change composition on the front side, back side, or both sides of the substrate as a plurality of dots using a ribbon printer or a diffusion process printer, with the plurality of dots cumulatively covering an area of the front side, back side, or both sides sufficient to reduce rub-off from the toner image bearing sides. The dots may also be applied only to the images rather than both the image-bearing and non-image-bearing surfaces of the substrate.

58 Claims, 3 Drawing Sheets

U.S. PATENT DOCUMENTS 5,609,425 A * 3/1997 Kawano et al. ..... 400/120.01
5,672,413 A 9/1997 Taylor et al.
5,771,431 A * 6/1998 Mitsuhata et al. ..... 399/307
5,805,969 A * 9/1998 Elsermans et al. ..... 399/341
5,827,918 A 10/1998 Titterington et al.
5,830,942 A 11/1998 King et al.
5,837,406 A * 11/1998 Tavernier et al. ..... 430/12
5,842,099 A * 11/1998 Aslam et al. ..... 399/324
5,879,790 A 3/1999 Sogabe et al.
5,922,114 A 7/1999 Sawada
5,954,865 A 9/1999 Sawada
5,958,169 A 9/1999 Titterington et al.
5,966,150 A 10/1999 Lester et al.
5,980,621 A 11/1999 Inaishi et al.
5,994,453 A 11/1999 Banning et al.
6,015,847 A 1/2000 Titterington et al.
6,018,005 A 1/2000 Banning et al.
6,022,910 A 2/2000 Nishizaki et al.
6,028,138 A 2/2000 Hahn et al.
6,037,396 A 3/2000 Sawada
6,048,925 A 4/2000 Titterington et al.
6,057,385 A 5/2000 Syutara et al.
6,063,729 A 5/2000 Eguchi et al.
6,412,935 B1 * 7/2002 Doumaux ..... 347/99
6,424,364 B2 * 7/2002 Gundlach et al. ..... 347/111
6,529,225 B1 * 3/2003 Shiraiwa et al. ..... 347/212
6,535,712 B2 * 3/2003 Richards ..... 399/341
6,567,642 B2 * 5/2003 Marsh ..... 399/341
2003/0030714 A1 * 2/2003 Marsh et al. ..... 347/105
2003/0031486 A1 * 2/2003 Marsh ..... 399/341
2003/0039753 A1 * 2/2003 Marsh ..... 427/256
2003/0096892 A1 * 5/2003 Marsh ..... 524/236

* cited by examiner

METHOD FOR REDUCING RUB-OFF FROM A TONER IMAGE USING A PHASE CHANGE COMPOSITION

RELATED APLICATIONS

This application is entitled to and hereby claims the benefit of the filing date of U.S. provisional application serial No. 60/310,873 filed Aug. 08, 2001.

FIELD OF THE INVENTION

This invention relates to a method for reducing rub-off from a substrate, such as paper, having a toner image on at least one side of the substrate by depositing a plurality of dots of a substantially clear phase change composition on the side of the substrate bearing the image with a ribbon printer or a diffusion process printer with the dots cumulatively covering an area of the substrate bearing the image sufficient to reduce rub-off from the substrate. This invention further relates to the use of a phase change composition deposited on the toner images on a substrate to prevent rub-off from the substrate.

BACKGROUND OF THE INVENTION

In electrophotographic printing, digital copying and copying processes, images are formed on selected substrates, typically paper, using small, dry, colored particles called toner. Toner usually comprises a thermoplastic resin binder, dye or pigment colorants, charge control additives, cleaning aids, fuser release additives and optionally, flow control and tribocharging control surface treatment additives.

The thermoplastic toner is typically attached to a print substrate by a combination of heating and pressure using a fusing subassembly that partially melts the toner into the paper fibers at the surface of the paper substrate. Additionally, the fused toner image surface finish can be controlled by the surface finish on the surface of the fuser roller. Thus, the gloss of the image may be controlled between diffuse (low gloss) and specular (high gloss). If the surface finish of the image is rough (diffuse) then light is scattered and image gloss is reduced.

Typically, in an electrophotographic printer, a heated fuser roller is used with a pressure roller to attach toner to a receiver and to control the image surface characteristics. Heat is typically applied to the fusing rollers by a resistance heater such as a halogen lamp. Heat can be applied to the inside of at least one hollow roller, and/or to the surface of at least one roller. At least one of the rollers is typically compliant. When the rollers of a heated roller fusing assembly are pressed together under pressure, the compliant roller deflects to form a fusing nip. Most heat transfer between the surface of the fusing roller and the toner occurs in the fusing nip. In order to minimize "offset," which is the amount of toner that adheres to the surface of the fuser roller, release oil is typically applied to the surface of the fuser roller via a wick roller. Typically, the release oil is silicone oil plus additives that improve attachment of the release oil to the surface of the fuser roller, and dissipate static charge buildup on the fuser rollers or fused prints. Some of the release oil becomes attached to the image and background areas of the fused prints.

Fused toner images can be substantially abraded or "rubbed-off" by processes such as duplex imaging, folding, sorting, stapling, binding, filing and the like. Residue from this abrasion process causes objectionable and undesirable marks on non-imaged areas of adjacent pages or covers. This process, and image quality defect, are known as "rub-off" and exist to varying extents in many electrophotographic copies and prints. The basic "requirements" for generation of rub-off are a donor (toner image), a receptor (adjacent paper page, envelope, mailing label, etc.), a differential velocity between donor and receptor, and a load between donor and receptor.

In general, mechanisms of rub-off are consistent with those of abrasive and adhesive wear mechanisms. Relevant factors include: toner toughness, toner brittleness (cross-linking density), surface energy or coefficient of friction of the toner, adhesion of the toner to the paper substrate, cohesive properties of the toner itself, the surface topography of the toner image, the level of load and the differential velocities of the wearing surfaces. Some of these factors are under the control of the machine and materials manufacturers, and some are under the control of the end user.

Toner rub-off may be reduced by the use of tougher toner, lower surface energy toner materials (resulting in lower coefficient of friction), better-fused toner, and a smoother toner image surface finish (but this increases image gloss.)

Unfortunately, there are undesirable consequences associated with each of the above rub-off reduction factors. A tougher toner is more difficult to pulverize, grind, and classify which increases manufacturing costs. Additionally, smaller toner particle size distributions are more difficult to achieve with tougher toner. Adding wax to the toner may provide additional release properties from the fuser roller surface, and add lubrication to the surface of the toner, but triboelectric charging behavior may be adversely affected.

A more easily fusible toner may create more toner offset to the surface of the fuser rollers, or increase the tendency of fused prints or copies to stick together in the finisher or output trays. Creating a more specular (smoother) image surface finish increases image gloss, which may be objectionable in some applications. Fuser release oil can lower the coefficient of friction of the fused image, but this effect is temporary since the oil is adsorbed into the paper substrate over time. Fuser release oil can also cause undesirable effects in the rest of the electrophotographic process, especially in duplex printing operations.

Extensive efforts have been directed to the development of improved method for reducing rub-off without modification of the fusing process.

SUMMARY OF THE INVENTION

According to the present invention, rub-off from a substrate bearing a toner image is reduced by a method for reducing rub-off from a substrate having a front side and a back side and bearing a toner image on its front side, or on its back side, or on both sides. The rub-off reduction method comprising: depositing a substantially clear phase change composition on the front side, the back side, or both sides of the substrate as a plurality of dots using a ribbon printer or a diffusion process printer, the dots cumulatively covering an area of the front side, back side, or both sides sufficient to reduce rub-off from the front side, back side, or both sides. For the sake of future convenience, the invention will be discussed with respect to having an image on one side only, but it is to be understood that the substrate may bear images on both sides.

The invention further relates to a method of reducing rub-off from a substrate having a front side and a back side and a plurality of printer or digital copier produced toner images on its front side, the method comprising: depositing a substantially clear phase change composition on at least a portion of the toner images as a plurality of dots using a ribbon printer or a diffusion process printer, the dots cumulatively covering an area of the toner images sufficient to reduce rub-off from the front side.

DESCRIPTION OF THE PREFERRED EMBODIMENTS

Figure 1:
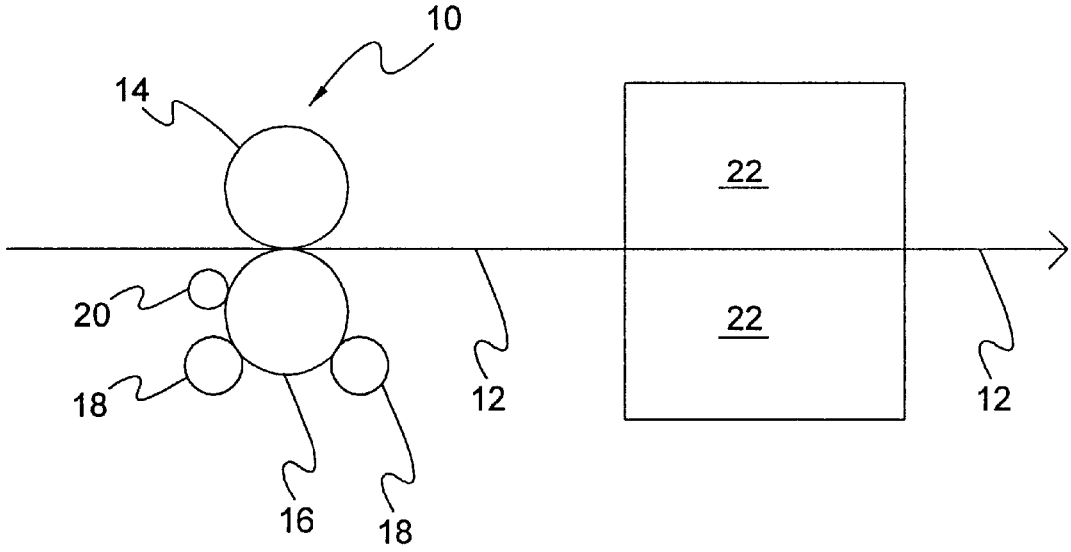
FIG. 1 shows an embodiment of the present invention.

Many electrophotographic processes produce prints or copies, which have a high rub-off of toner onto adjacent receiver sheets that is considered unacceptable by some users. The amount of rub-off depends upon the particular machine hardware, oiling rates and the like. Typical values from 19 to 25 are measured at 3 psi (pounds per square inch) using the test procedure described herein for copies that have been aged for about 100 hours.

The existing toners in some instances do not have a wax lubricant and offer little protection against rub-off. The electrophotographic process typically forms images on selected substrates, which are typically paper, using small, dry, colored particles called toner. Toners usually comprise a thermoplastic resin binder, dye or pigment colorants, charge control additives, cleaning aids, fuser release additives and, optionally, flow control and tribocharging control surface treatment additives.

Certain characteristics of the fused toner image are inherent. Since the fused toner is only partially melted, it does not completely penetrate into the paper fibers on the surface of the paper. The toner image forms a relief image and projects above the surface of the paper. The height of the toner image above the surface of the paper substrate is dependent on the particle size of the toner particles. Small particles result in a lower image height.

The thermal-mechanical properties of the toner, such as melting point, glass transition temperature, and rheological flow characteristics also affect rub-off. Fused toner images can be substantially abraded or rubbed-off by processes such as duplex imaging, folding, sorting, stapling, binding and filing. Residue from this abrasion process causes objectionable and undesirable marks on non-imaged areas of adjacent pages or covers. This image quality defect is known as rub-off and is common on many electrophotographic copies and prints. The basic requirements for generating rub-off are a donor (toner image), a receptor (adjacent paper page, envelope, mailing label, etc.), differential velocity between donor and receptor, and a load pressing the donor against the receptor.

Toner rub-off may be reduced by the use of tougher toner, lower surface energy toner materials (resulting in a lower coefficient of friction), better-fused toner, and a smoother toner image surface finish (but this increases image gloss).

Unfortunately, there are undesirable consequences associated with each of the above rub-off reduction factors. A tougher toner is more difficult to pulverize, grind, and classify which increases manufacturing costs. Additionally, smaller toner particle size distributions are more difficult to achieve with tougher toner. Adding wax to the toner may provide additional release properties from the fuser roller surface, and add lubrication to the surface of the toner, but triboelectric charging behavior may be adversely affected. A more easily fusible toner may create more toner offset to the surface of the fuser rollers, or increase the tendency of used prints or copies to stick together in the finisher or output trays. Creating a more specular (smoother) image surface finish increases image gloss, which may be objectionable in some applications.

Fuser release oil can lower the coefficient of friction of the fused image, but this affect is temporary since the oil is adsorbed into the paper substrate over time. Fuser release oil can also cause undesirable effects to the rest of the electrophotographic process, especially in duplex printing operations. The use of ribbon printing or diffusion printing to deposit a plurality of dots of a phase change composition or a hot melt wax to pre-printed paper documents, is a technique for reducing toner rub-off that is not susceptible to the above-mentioned disadvantages.

Hot melt type inks, also referred to as phase change inks, typically comprise a carrier such as a polymeric or wax material and a colorant. Ink jet printing systems, ribbon printing systems and diffusion printing systems are known to those skilled in the art and use phase change composition inks (hot melt type ink).

Many suitable carrier materials are known for phase change printers. When the ink is omitted from these materials, they basically comprise a carrier for the ink, without the colorant. Many of these materials are substantially colorless.

Ribbon printers and diffusion printing systems typically provide the capability of providing a resolution of about 300 or more dpi (dots per inch). When printing a square matrix with such printers, it is possible to print with a resolution equal to 300 dpi in both a cross-track and an in-track direction. This produces a square of print dots referred to as a matrix, which contains the potential for 300 dots along each axis. This resolution provides excellent print quality. For convenience sake, all printing resolutions will hereinafter be reported as cross-scan versus in-scan dpi resolutions. Ribbon printer print heads and diffusion process printers having lesser resolutions of 50×300, 100×300, 200×300 dpi and the like are also available. Further, such print heads having a 300×300 resolution can be programmed to produce dots at a lesser cross-track frequency. Such printers produce single pixel ink drops, which are deposited onto the substrate where they instantly solidify. The single pixels are typically from about 12 to about 14 microns in height and form a dot which is typically about 83 microns in diameter and which typically contains about 80 nanograms of material per pixel. Such ribbon printers and thermal diffusion printing systems are considered to be well known to those skilled in the art and are readily available.

In the present invention, thermal transfer process technology, which is not susceptible to the disadvantages accompanying modification of the toner and the like, is used. In the present invention, phase change compositions, which contain no colorant and are substantially transparent, are used. The phase change composition dots are applied by a ribbon printer or a thermal diffusion printer. Ribbon printers comprise the use of hot melt thermal transfer sheets formed by coating a phase change composition on one side of a substrate film to form a sheet (ribbon), which is then used as a thermal transfer sheet (ribbon) for printing dots on the substrate bearing toner images. Such thermal transfer ribbons are well known to those skilled in the art.

In the present invention, a ribbon printer having a plurality of individually addressable thermal elements arranged in a cross-process direction in contact with a full width thermal transfer sheet (ribbon) bearing the phase composition material located in end-to-end relation across the process direction of motion of the substrate bearing the toner image is brought into contact with the substrate bearing the toner image and the thermal elements are selectively activated to deposit dots of the phase change composition in a desired amount on the substrate bearing the toner image. The thermal elements that are in direct contact with the thermal transfer sheet are activated to produce heat, which melts the wax. The carrier ribbon is positioned to extend across the width of the substrate bearing the toner image and is gradually advanced parallel to the substrate flow direction to provide new thermal transfer sheet as required for deposition of the dots by activation of the thermal elements. The thermal transfer sheet (ribbon) is in direct contact with the substrate surface in this embodiment. Desirably, the dots are deposited over a relatively limited area of the substrate bearing the toner image in an amount sufficient to reduce rub-off of the toner image on this substrate sheet, which is typically paper.

Accordingly, this thermal transfer print head (ribbon printer) functions by transferring phase change composition from the carrier ribbon directly to the toner-bearing substrate, as the substrate is moved across the print head with the ribbon and the substrate being in a contact relationship. As a result of the direct contact, no aerosol sprays or wax or other resulting contamination on mechanical and electrical parts is anticipated.

An alternate process known as a thermal diffusion, diffusion, dye diffusion or a dye sublimation process also uses a print head with a plurality of individually energizable heating elements and a carrier sheet (ribbon) bearing the phase change composition. In this diffusion process, intimate contact is not required but the ribbon is separated from the substrate by a small gap typically about 0.001 inch. In this instance, the thermal elements are activated to melt the wax and allow it to diffuse across the small gap. Laser scanning assemblies may also be used as a replacement for thermal print head technology for this application.

Both these technologies may be used for the direct application of wax onto preprinted pages or substrates. Also the phase change material may be applied only to the toner images on a page by selecting the proper laser scanner or print head elements which when activated deposit dots on the image. Both these processes result in substantially instant freezing of the droplets on the substrate or page and actual penetration of the droplets into the page is minimized. Accordingly, the droplets do not spread substantially after encountering a page. Therefore, multiple discrete areas of phase change composition may be applied as a predefined pattern of data onto the toner sheet.

Both these techniques are considered to be well known to those skilled in the art and no further discussion of these techniques is considered necessary. They are used in the present invention as known vehicles to deposit the droplets onto the substrate toner sheet to reduce rub-off in the inventive process.

Some systems of this type are shown in U.S. Pat. Nos. 3,984,809; 4,458,253; 4,568,949; 4,851,045; 5,879,790; and 6,057,385. These references are hereby incorporated in their entirety by reference.

Such phase change inks (hot melt inks) are desirable for ink jet, ribbon and diffusion printers because they remain in a solid state at room temperature during storage and shipment. In addition, problems associated with ink evaporation are eliminated and improved reliability of printing is achieved. When the drops of the hot melt ink are applied directly onto a substrate such as paper, the drops solidify immediately on contact with the substrate and migration of ink on the surface of the substrate is prevented.

Such hot melt waxes developed for full process color printing in graphics arts applications contain a wax vehicle, colorants, surfactants and dispersants to enable compatibility of the dye with anti-oxidants, cross-linking agents and the like. These waxes are also desirably modified to prevent crystallinity that will negatively impact the color hue.

Colorless hot melt waxes for use in rub-off reduction of electrophotographic toner images do not require surfactants, dispersants, colorants or dye. They may also contain slip agents, such as erucamide, stearyl stearamide, lithium stearates, zinc stearates organic stearates, and the like to provide low surface energy properties to avoid offsetting of the wax material to receiver substrates. These waxes are preferentially crystalline to enable low gloss. Therefore, high melting waxes with sharp melting point ranges are desirable. Preferably, the waxes or other polymeric materials used have a melting point from about 80 to about 130° C. with a melting range (starts- to-melt to starts-to-freeze range) of about 15° C., and desirably about 10° C. Desirably these waxes or other polymeric materials are crystalline in solid form, have a low coefficient of friction and are odorless. Some suitable materials are waxes, polyethylene, polyalphaolefins, and polyolefins.

U.S. Pat. No. 5,958,169 discloses various hot wax compositions for use in ink jet printers.

U.S. Pat. No. 6,018,005 discloses the use of urethane isocyanates, mono-amides, and polyethylene wax as hot melt wax compositions. The polyethylene is used at about 30 to about 80 percent by weight and preferably has a molecular weight between about 800 and about 1200.

U.S. Pat. No. 6,028,138 discloses phase change ink formulations using urethane isocyanate-derived resins, polyethylene wax, and a toughening agent. U.S. Pat. No. 6,048,925 discloses urethane isocyanate-derived resins for use in a phase change ink formulation. Both of these references disclose the use of a hydroxyl containing toughening agent.

Additional formulations are disclosed in U.S. Pat. Nos. 5,922,114; 5,954,865; 5,980,621; 6,022,910; and, 6,037,396.

U.S. Pat. No. 5,994,453 discloses phase change carrier compositions made by the combination of at least one urethane resin, at least one urethane/urea resin, at least one mono-amide and at least one polyethylene wax. This reference discloses further that the polyethylene may be employed as an overcoat on a printed substrate. The overcoat is supplied to protect from about 1 to about 25 percent of the surface area of the printed substrate. The treatment is disclosed to give enhanced anti-blocking properties to the prints and to provide enhanced document feeding performance of the ink-bearing substrates for subsequent operations, such as photocopying. This reference discloses the use of printing comprising images of phase change waxes, which are treated by over-spraying the substrate bearing the images of phase change waxes. The reference does not address in any way the treatment of substrates bearing toner images. Toner images, as discussed above, are radically different than phase change ink images in their properties. Further, this reference does not address the reduction of rub-off of toner images.

All of the patents noted above are hereby incorporated in their entirety by reference.

According to the present invention, rub-off of toner images from a substrate having a front side and a back side and bearing a toner image on its front side is reduced by depositing a plurality of dots of a substantially clear phase change composition on the front side of the substrate with the dots cumulatively covering an area of the front side sufficient to reduce rub-off from the front side.

In FIG. 1, a schematic diagram of an embodiment the present invention is shown. The embodiment shown includes a fusing assembly 10, which includes a process flow of a suitable substrate such as paper shown by line 12. A pressure roller 14 and a fuser roller 16 are in engagement to create a nip to perform a heat/pressure treatment of the toner on the paper. As well known to those skilled in the art, heater rollers 18 may be used to heat the fuser roller 16 and a wick roller 20 is typically used to supply a suitable oil to fuser 16. A ribbon printer or laser jet printer 22 may be used on either or both sides of the substrate, depending upon whether a toner image is positioned on both sides.

The toner image on the substrate may be positioned on the lower side of the substrate and the ribbon or laser printer providing the dot matrix on the substrate urface bearing the toner will be positioned beneath the substrate. Alternatively, the ribbon or laser printer may be above a substrate having a toner image on its upper side and is still effective to deposit the dots on the surface of this substrate bearing a toner image. Alternatively, both sides of the substrate may be coated if both sides bear a toner image. Such variations are well known to those skilled in the art. Further, fuser assemblies, ribbon printers, laser jet and other diffusion-type printers are well known to those skilled in the art and need not be discussed in detail.

The dots may cumulatively cover from about 0.25 to about 8.00 percent of the total area of the front side of the substrate. Preferably, the coverage is from about 0.25 to about 6.00 percent. Typically, the dots are deposited in a matrix pattern since the print heads are capable of depositing the dots as a plurality of pixels at a spacing of 300×300 dpi. Desirably, the dots as positioned on the substrate have a resolution from about 50×300 to about 300×300 dpi and preferably; the resolution is at least about 100×300 dpi.

The dots may be arranged in a plurality of patterns. For instance, the dots may be arranged in a square matrix pattern. Such square matrix patterns suffer the disadvantage that when a second sheet in contact with a first sheet bearing a toner image is moved relative to the first sheet, the rub-off can occur in streaks corresponding to the area between the dots. Another configuration comprises the use of lines of dots. These lines can be placed in any orientation from perpendicular to or diagonal to the anticipated line of movement of a contacting second page of paper or the like. Further, the lines can be used in a square matrix. In any instance, it is desirable that the lines be spaced at a distance less than about 1 (one) inch.

Preferably, the dots are arranged in a random matrix pattern. The use of the random matrix arrangement results in a dot pattern, which provides relatively uniform protection whichever way the substrate is moved relative to a second page.

As is well known, the dots typically include about 20 to about 80 nanograms of phase change material and typically have a height of about 10 to about 16 microns. More typically, the height of the dots is from about 10 to about 12 microns. This is roughly the same as the height of the toner image typically produced on a paper substrate. In some instances, it may be desirable to place a second dot on top of a previous dot. Such is readily accomplished by depositing two drops at the same location. In such instances, the height of the dot may be from about 20 to about 30 microns above the substrate surface. Of course, such doubled dots will contain double the amount of phase change material. Further, the dots may be formed as a plurality of pixels to form, for instance, a period.

Typically, a period sized dot would contain 4 pixels of material, which might contain from about 80 to about 320 nanograms of phase change composition, and be from about 10 to about 16 microns in height above the substrate. It has been found that the use of such dots on the substrate surface is effective to greatly reduce the rub-off of the toner image when the toner image is brought into contact with another substrate and moved relative to the other substrate.

Typically, the phase change composition is selected from the group consisting of polymeric materials and waxes having a melting point from about 80 to about 130° C., a melting point range of less than about 15° C., a crystalline form as a solid, a static coefficient of friction less than about 0.62, and being substantially odorless. Desirably, the melting range is less than about 10° C. Typically, the phase change material comprises at least one component selected from the group consisting of waxes, polyethylene, polyalphaolefins, and polyolefins and may contain a friction reducing material such as described above. Many phase change compositions suitable for use as carriers in ink jet printers are suitable for use in the present invention if they meet the physical requirements set forth above.

Typically, the toner image produced by an electrophotographic process may also be produced by digital printing or digital copying processes, which are effectively treated by the process of the present invention.

Further, the substrate may have a toner image on both the front and the backside of the substrate. The phase change composition may be deposited on both sides of the substrate. The most commonly used substrate is paper.

While the method discussed above relates to covering the entire sheet with the plurality of dots, the present method is also useful to reduce rub-off from a substrate having a front side and a back side and bearing printer or digital copier produced toner images on its front side by depositing a substantially clear phase change composition on at least a portion of the toner images as a plurality of dots. The dots cumulatively cover an area of the toner images sufficient to reduce rub-off from the front side. Typically, this area is from about 0.25 to about 8.00 percent of the image area. Preferably, this area is from about 0.25 to about 6.00 percent of the image area.

The dots are deposited with a ribbon or diffusion printer as discussed previously and the dots, as discussed previously, are desirably arranged in a random matrix pattern with a resolution from about 50×300 to about 300×300 dpi. Desirably, the resolution is at least about 100×300 dpi. The properties of the dots and the composition of dots are as discussed previously. The dots may be positioned on the images over either the entire image at the desired spacing or they may be positioned selectively as one or more rows of pixels at a desired spacing around the outside of the images. The amount of phase change material applied to the images in this fashion is determined by an evaluation of the amount of material required to reduce rub-off to a desired level.

The dots may also or alternatively be applied to the area immediately surrounding the images. This results in desirable protection with a reduced amount of phase change material. The dots may be placed either on the image, around the edges (rim) of the images, around but not on the images (adjacent to the images) or in any other desired pattern on or around the images or in any combination of dots positioned on or around the image. The areas adjacent to the image, which are selected for positioning of dots, can vary widely but are desirably areas adjacent to the image and preferably the dots are spaced within a distance up to from 1 to 2 times the distance across the image from the image.

The use of the dots in this fashion results in a marked reduction of the rub-off. Typically, the rub-off from an untreated page bearing a dense printed image pattern is from about 19 to about 25 using a 3-psi weight using the test procedure discussed hereinafter.

Test Procedure

The Test Procedure used basically involves the use of a selected weight positioned on top of a receiver sheet, which is a clean sheet of paper positioned above a toner image-bearing sheet positioned with an image—bearing side facing the receiver sheet. The toner image-bearing sheet is then slid a controlled distance under the weight on the upper sheet. The resulting discoloration of the upper sheet is then compared to a standard to produce a numeric indication of the degree of rub-off. The degree of rub-off from a clean sheet is 3.0. The rub-off of untreated toner image-bearing copies is typically from about 19 to about 25. Typically, a standard test pattern is used to test the efficiency of the dot distribution. The test sheets used for the tests herein are referred to in the copying industry as Gutenberg sheets. These sheets are sheets of alternating very closely spaced lines of images of varying sizes. Desirably, a standard image of this type is used for all tests. The dots or other treatment applied is then readily evaluated for efficacy in reducing rub-off. As indicated above, the weight used for all tests in this application was 3 psi and the tests were performed by comparing all of the samples to the same set of standards to determine rub-off evaluation numbers.

Further, rubbed patches resulting from the tests were analyzed as follows:

a) six rub-off patches were produced for each test. These test patches were first scanned on a calibrated scanner with the resulting scans or image being saved using a standard format;

b) the patch image was then evaluated and a standard deviation of the density values from each patch is calculated. Applications such as Pro Shop or Math Cad can be used. It has been demonstrated that the results are identical. The standard deviation, so long as the mean density is below 0.30, has been shown to correlate with the subjective measures of the amount of toner on the sheets evaluated;

c) the standard deviations of each patch were then averaged and the statistics provided for the test samples; and, d) the average of the six standard deviations was reported as the rub-off value for any particular test.

The test sheets, as indicated, are sheets with densely spaced images across the surface of the paper. To avoid any tendency to form streaks in the test apparatus, the test sheet was turned to an angle of 7 (seven) degrees relative to the direction of movement relative to the top clean sheet. The 7-degree angle has been selected arbitrarily and can be any suitable angle so long as the printed sheet is turned to a sufficient extent to avoid a tendency to streak as a result of pulling the same letters of the sheet under the weighted area of the clean test sheet along the path of the test sheet.

A suitable test method is disclosed in U.S. patent application, U.S. Ser. No. 09/804,863 filed Mar. 13, 2001, by John R. Lawson, Gerard Darby, II, and Joe A. Basile, entitled Rub-off Test Method and Apparatus.

EXAMPLE 1

Figure 2:
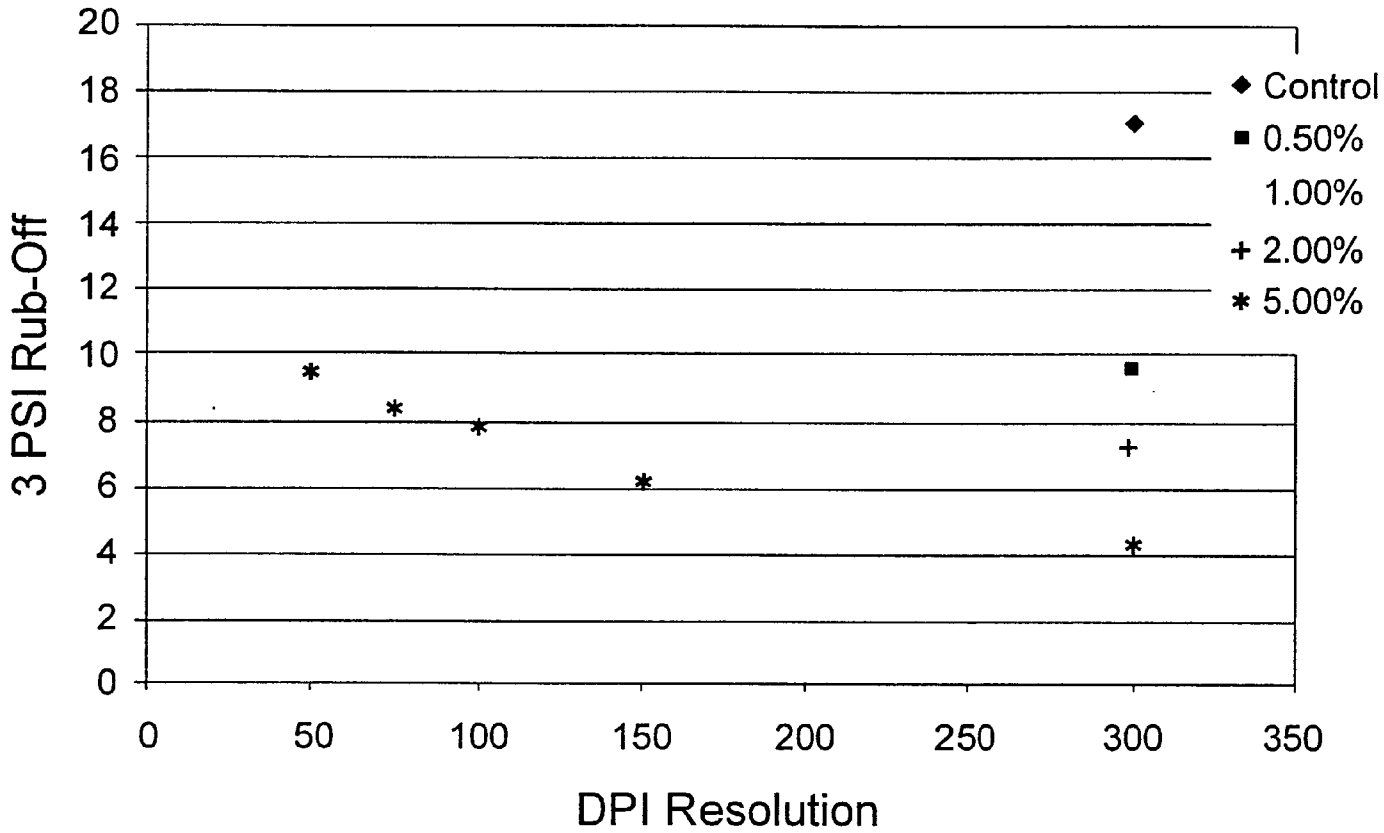
FIG. 2 shows the test results from example 1.

An Alps ribbon printer was used to apply wax in random dot patterns at area coverages of 0.5%, 1.0%, 2.0%, and 5.0%. The data is shown in FIG. 2. At a print resolution of 300×300 dpi, the application of wax at five percent area coverage of the paper reduces the 3-psi rub-off from about 17 down to about 4. The observed trend from 50×300 dpi up to 300×300 dpi print resolutions shows that improved results are achieved at the higher resolutions.

EXAMPLE 2

Tests were performed using the Alps ribbon printer and an ink jet printer at the wax area coverages shown using the same phase change composition. The test results are shown in FIG. 3.

Figure 3:
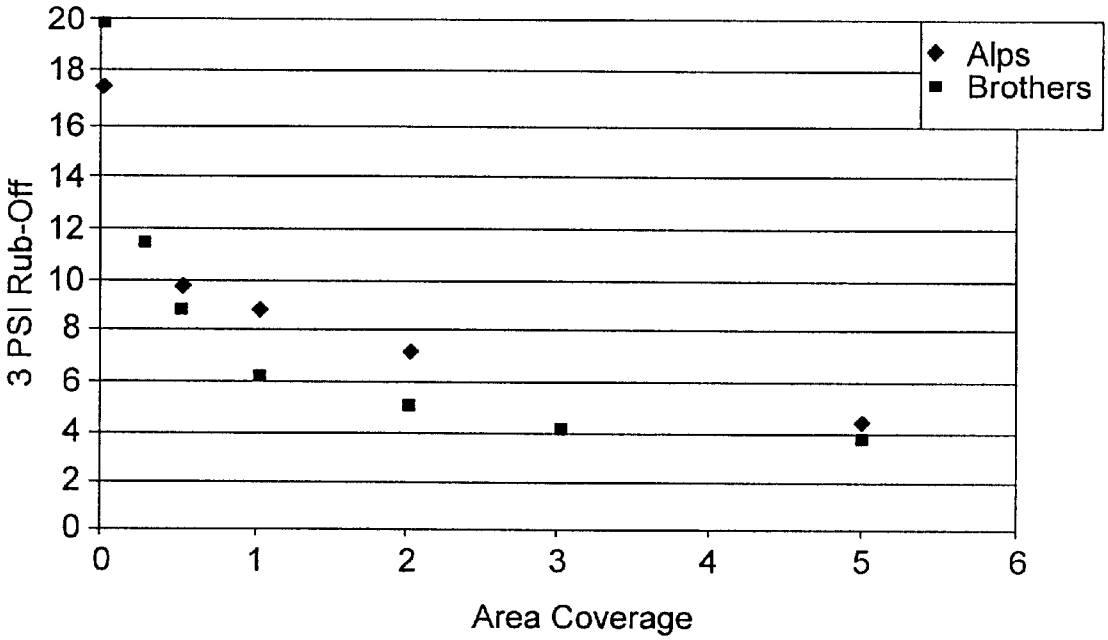
FIG. 3 shows the test results from example 2.

FIG. 3 shows that the Alps thermal ribbon printer, phase change composition transfer process is nearly identical to the transfer process by an ink jet printer.

Tests have been performed to determine whether the presence of the dots on the substrate resulted in any substantial change in the appearance. On balance, the conclusion was that no apparent difference resulted from the use of the dots on the substrate to produce the reduced rub-off.

It should be well understood that the use of the method of the present invention can be implemented by the use of a ribbon or diffusion process printer or the like to coat substrates bearing a toner image as they are produced in a printer or copier machine. The prints can be produced by analog photocopying processes, digitally, or the like. Further, the dot application system may be implemented as a part of the photocopier or printer machine, or as a stand-alone unit, which may apply rub-off reducing material in a separate step.

Many variations are possible within the scope of the present invention and many such variations may be considered obvious and desirable by those skilled in the art. For instance, a wide variety of wax and polymeric materials having the physical properties set forth above may be found effective. Further, it may be found desirable to imprint an indication of reduced rub-off treatment at the same time as the dots are applied in order to provide promotional labeling for treatment by the method of the present invention or it may be desirable to print colored images over a portion of the substrate as the dots are applied. Such variations are considered to be well known to those skilled in the art.

As discussed previously, the development and use of a variety of polymeric and wax materials having suitable properties for use in ink jet, ribbon and diffusion printers for use as carriers for phase change inks and the like are well known. Many of these materials have been shown in patents referred to herein and in other patents available as open literature. Further, the use of ribbon and diffusion printers is well known to those skilled in the art and a variety of systems for applying phase change composition images to substrates is available on the open market.

Having disclosed the present invention by reference to certain of its preferred embodiments, it is respectfully pointed out that the embodiments described are illustrative rather than limiting in nature and that many variations and modifications are possible within the scope of the present invention. Many such variations and modifications may be considered obvious and desirable by those skilled in the art based upon the foregoing description of preferred embodiments.

Having thus described the invention, I claim:

1. A method for reducing rub-off from a substrate having a front side and a back side and bearing a toner image on its front side, the method comprising:

depositing a substantially clear phase change composition on the front side of the substrate using a ribbon printer as a plurality of dots, the dots cumulatively covering an area of the front side sufficient to reduce rub-off from the front side.

2. The method of claim 1 wherein the dots cumulatively cover from about 0.25 to about 8.00 percent of the area of image bearing sides of the substrate.

3. The method of claim 1 wherein the ribbon printer comprises a thermal transfer print head having a plurality of individually addressable thermal elements arranged in a cross process direction and a full width carrier sheet (ribbon) bearing the phase changed composition in contact with the front side of the substrate.

4. The method of claim 3 wherein the carrier sheet (ribbon) is located in an end-to-end relation across a process direction of motion of the substrate.

5. The method of claim 3 wherein the dots are arranged in a matrix pattern.

6. The method of claim 3 wherein the ribbon printer has a cross-track to in-track resolution from about 50×300 to about 300×300 dpi.

7. The method of claim 6 wherein the resolution is at least about 100×300 dpi.

8. The method of claim 7 wherein the dots are arranged in a square matrix array.

9. The method of claim 3 wherein dots are arranged in a random matrix pattern.

10. The method of claim 3 wherein at least a majority of the dots each contain from about 20 to about 80 nanograms of phase change composition.

11. The method of claim 3 wherein the dots are from about 10 to about 16 microns in height above the substrate surface.

12. The method of claim 3 wherein the dots contain from about 40 to about 160 nanograms of phase change composition and wherein the dots are from about 10 to about 16 microns in height above the substrate surface.

13. The method of claim 3 wherein the dots contain from about 80 to about 320 nanograms of phase change composition and are from about 20 to about 30 microns in height above the substrate surface.

14. The method of claim 1 wherein the phase change composition is selected from the group consisting of polymeric materials and waxes having a melting point from about 80 to about 130° C., a melting range of less than about 15° C., a crystalline form as a solid, a static coefficient of friction less than about 0.62 and being substantially odorless.

15. The method of claim 14 wherein the melting range is less than about 10° C.

16. The method of claim 15 wherein the phases change composition comprises at least one component selected from the group consisting of waxes, polyethylene, polyalphaolefins, and polyolefins.

17. The method of claim 1 wherein the substrate bears a toner image on both the front side and the backside and wherein the phase change composition is deposited on both sides of the substrate.

18. The method of claim 1 wherein the substrate is paper.

19. A method of reducing rub-off from a substrate bearing having a front side and a back side and a plurality of printer or digital copier produced toner images on its front side, the method comprising depositing a substantially clear phase change composition on at least a portion of the toner images as a plurality of dots using a ribbon printer, the dots cumulatively covering an area of the toner images sufficient to reduce rub-off from the front side.

20. The method of claim 19 wherein the dots cumulatively cover from about 0.25 to about 8.00 percent of the images.

21. The method of claim 19 wherein the dots are deposited by the ribbon printer having a cross-track to in-track resolution from about 50×300 to about 300×300 dpi.

22. The method of claim 21 wherein the resolution is at least about 100×300 dpi.

23. The method of claim 21 wherein the dots are arranged in a random matrix pattern.

24. The method of claim 21 wherein at least a majority of the dots contain from about 20 to about 80 nanograms of phase change composition.

25. The method of claim 19 wherein the dots are from about 10 to about 16 microns in height above the substrate surface.

26. The method of claim 19 wherein the phase change composition is selected from the group consisting of polymeric materials and waxes having a melting point from about 80 to about 130° C., a melting range of less than about 15° C., a crystalline form as a solid, static coefficient of friction less than about 0.62 and being substantially odorless.

27. The method of claim 26 wherein the phase change composition comprises at least one component selected from the group consisting of waxes, polyethylene, polyalphaolefins, and polyolefins.

28. The method of claim 19 wherein the substrate has a toner image on both the front side and on the backside and wherein the phase change composition is deposited on the toner images on both sides of the substrate.

29. The method of claim 19 wherein the substrate is paper.

30. The method of claim 19 wherein the dots are deposited in rim areas of the toner images.

31. The method of claim 19 wherein the dots are deposited on the toner images and on the adjacent areas of the substrate.

32. A method for reducing rub-off from a substrate having a front side and a back side and bearing a toner image on its front side, the method comprising:

depositing a substantially clear phase change composition on the front side of the substrate using a diffusion process printer as a plurality of dots, the dots cumulatively covering an area of the front side sufficient to reduce rub-off from the front side.

33. The method of claim 32 wherein the dots cumulatively cover from about 0.25 to about 8.00 percent of the area of the front side of the substrate.

34. The method of claim 32 wherein the diffusion process printer comprises a plurality of individually energizable heating elements arranged in a cross process direction and a full width carrier bearing the phase change composition separated by a small gap from the front side of the substrate.

35. The method of claim 32 wherein the carrier sheet is located in an end-to-end relation with the process direction.

36. The method of claim 32 wherein the heating element is a scanning laser.

37. The method of claim 32 wherein the dots are arranged in a matrix pattern.

38. The method of claim 32 wherein the diffusion process printer has a cross-track to in-track resolution from about 50×300 to about 300×300 dpi.

39. The method of claim 32 wherein the resolution is at least about 100×300 dpi.

40. The method of claim 32 wherein dots are arranged in a random matrix pattern.

41. The method of claim 32 wherein at least a majority of the dots each contain from about 20 to about 80 nanograms of phase change composition.

42. The method of claim 32 wherein the dots are from about 10 to about 16 microns in height above the substrate surface.

43. The method of claim 32 wherein the dots contain from about 40 to about 160 nanograms of phase change composition and wherein the dots are from about 10 to about 16 microns in height above the substrate surface.

44. The method of claim 32 wherein the dots contain from about 80 to about 320 nanograms of phase change composition and are from about 20 to about 30 microns in height above the substrate surface.

45. The method of claim 44 wherein the phase change composition is selected from the group consisting of polymeric materials and waxes having a melting point from about 80 to about 130° C., a melting range of less than about 15° C., a crystalline form as a solid, a static coefficient of friction less than about 0.62 and being substantially odorless.

46. The method of claim 32 wherein the phase change composition comprises at least one component selected from the group consisting of waxes, polyethylene, polyalphaolefins, and polyolefins.

47. The method of claim 32 wherein the substrate bears a toner image on both the front side and the backside and wherein the phase change composition is deposited on both sides of the substrate.

48. The method of claim 32 wherein the substrate is paper.

49. A method of reducing rub-off from a substrate bearing having a front side and a back side and a plurality of printer or digital copier produced toner images on its front side, the method comprising depositing a substantially clear phase change composition on at least a portion of the toner images as a plurality of dots using a diffusion process printer, the dots cumulatively covering an area of the toner images sufficient to reduce rub-off from the front side.

50. The method of claim 49 wherein the dots cumulatively cover from about 0.25 to about 8.00 percent of the images.

51. The method of claim 49 wherein the dots are deposited by the diffusion process printer having a cross-track to in-track resolution from about 50×300 to about 300×300 dpi.

52. The method of claim 49 wherein the dots are arranged in a random matrix pattern.

53. The method of claim 49 wherein the phase change composition is selected from the group consisting of polymeric materials and waxes having a melting point from about 80 to about 130° C., a melting range of less than about 15° C., a crystalline form as a solid, static coefficient of friction less than about 0.62 and being substantially odorless.

54. The method of claim 49 wherein the phase change composition comprises at least one component selected from the group consisting of waxes, polyethylene, polyalphaolefins, and polyolefins.

55. The method of claim 49 wherein the substrate has a toner image on both the front side and on the backside and wherein the phase change composition is deposited on the toner images on both sides of the substrate.

56. The method of claim 49 wherein the substrate is paper.

57. The method of claim 49 wherein the dots are deposited in rim areas of the toner images.

58. The method of claim 49 wherein the dots are deposited on the toner images and on the adjacent areas of the substrate.

* * * * *